US008245676B2

(12) United States Patent
Yang et al.

(10) Patent No.: US 8,245,676 B2
(45) Date of Patent: Aug. 21, 2012

(54) CONTINUOUSLY VARIABLE VALVE LIFT DEVICE OF ENGINE

(75) Inventors: Jei Choon Yang, Yongin-si (KR); Byong Young Choi, Incheon (KR); Young Hong Kwak, Suwon-si (KR); Ki Young Kwon, Seoul (KR); Jin Kook Kong, Suwon-si (KR); Soo Hyung Woo, Yongin-si (KR); Jin Soon Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 262 days.

(21) Appl. No.: 12/835,434

(22) Filed: Jul. 13, 2010

(65) Prior Publication Data

US 2011/0036318 A1 Feb. 17, 2011

(30) Foreign Application Priority Data

Aug. 13, 2009 (KR) ..... 10-2009-0074753

(51) Int. Cl.
*F01L 1/34* (2006.01)

(52) U.S. Cl. ..... 123/90.16; 123/90.39

(58) Field of Classification Search ..... 123/90.16, 123/90.39; 74/559, 569
See application file for complete search history.

(56) References Cited

U.S. PATENT DOCUMENTS

| | | | | |
|---|---|---|---|---|
| 5,778,840 | A | 7/1998 | Murata et al. | |
| 7,117,831 | B2 | 10/2006 | Methley | |
| 7,409,934 | B2 | 8/2008 | Lee et al. | |
| 2006/0201460 | A1 * | 9/2006 | Yamada | 123/90.16 |

FOREIGN PATENT DOCUMENTS

| | | | |
|---|---|---|---|
| JP | 54-140015 | A | 10/1979 |
| JP | 5-26016 | A | 2/1993 |
| JP | 11-81945 | A | 3/1999 |
| JP | 2000-291417 | A | 10/2000 |
| JP | 2005-320887 | A | 11/2005 |

* cited by examiner

*Primary Examiner* — Zelalem Eshete
(74) *Attorney, Agent, or Firm* — Morgan, Lewis & Bockius LLP

(57) ABSTRACT

A continuously variable valve lift device of an engine may include a cam shaft having an eccentric cam formed on an outer peripheral surface of the cam shaft so that an oscillating outer-race wheel is coupled to and oscillatable along the eccentric cam, an output cam being rotably fitted to the cam shaft, a sliding shaft for varying the position of the output cam by moving straightly in a front and rear direction according to an engine operating condition, in which the sliding shaft has a deviation adjustment member which is formed to be eccentric toward an outer peripheral surface thereof, and a rocker arm rotably fitted to the deviation adjustment member and one end of which is rotably connected to the oscillating outer-race wheel and the other end of which is rotably engaged with the output cam.

8 Claims, 6 Drawing Sheets

CONTINUOUSLY VARIABLE VALVE LIFT DEVICE OF ENGINE

CROSS-REFERENCE TO RELATED APPLICATION

The present application claims priority to Korean Patent Application Number 10-2009-0074753, filed on Aug. 13, 2009, the entire contents of which are incorporated herein for all purposes by this reference.

BACKGROUND OF THE INVENTION

1. Field of the Invention

The present invention relates to a continuously variable valve lift device of an engine. More particularly, the present invention relates to a continuously variable valve lift device of an engine, in which it is capable of controlling a deviation of the valve lift.

2. Description of Prior Art

Recently, in order to improve the thermal efficiency and the output of an engine for a vehicle, an attempt for varying each of a valve lift of an intake/exhaust valve, a valve timing and an opening/closing time has been lively accomplished. As the result of the efforts, one of the developed apparatuses is a continuously variable valve lift (CVVL).

That is, since the continuously variable valve lift for the vehicle may optimally control a valve motion such as a valve timing of the intake/exhaust valve, the valve lift and the like, corresponding to an engine operating condition, it may maximize an intake flow at a high-speed/high-load condition where a high output is required, and may minimize an internal exhaust gas recirculation (EGR) effect or a throttle loss at a low-speed/low-load condition where an enhancement of a fuel efficiency or a reduction of an exhaust gas is important.

The continuously variable valve lifts have been developed in various structures, and one of them is a continuously variable valve lift with a link structure, in which a torque of a driving cam is transmitted through a link mechanism to lift a valve.

The continuously variable valve lift with a link structure may generate a tolerance in assembling each of various links. The accumulated amount of the tolerance may generate a deviation according to a difference between a first-designed valve profile and an actually-measured valve profile. Accordingly, it may need to correct the deviation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve lift device of an engine, in which it is capable of controlling a deviation of the valve lift.

In an aspect of the present invention, the continuously variable valve lift device of an engine, may include a cam shaft having an eccentric cam formed on an outer peripheral surface of the cam shaft so that an oscillating outer-race wheel is coupled to and oscillatable along the eccentric cam, an output cam being rotably fitted to the cam shaft, a sliding shaft for varying the position of the output cam by moving straightly in a front and rear direction according to an engine operating condition, in which the sliding shaft has a deviation adjustment member which is formed to be eccentric toward an outer peripheral surface thereof, and a rocker arm rotably fitted to the deviation adjustment member and one end of which is rotably connected to the oscillating outer-race wheel and the other end of which is rotably engaged with the output cam.

The other end of the rocker arm may be rotably coupled to an end of an output cam link and an end of the output cam is rotably coupled to the other end of the output cam link.

A driving member may be fitted to a side of the sliding shaft in order to straightly move the sliding shaft in a front and rear direction.

The driving member may include a control shaft being arranged parallel to the sliding shaft, in which a control deviation cam is formed on an outer peripheral surface of the control shaft, a control link for pivotally connecting the control deviation cam with the sliding shaft, and an actuator engaged with the control shaft for rotating the control shaft.

An actuator pin may be rotatably inserted into an fitting part formed in an end portion of the control link and a worm is formed at an outer peripheral surface of the actuator pin, and a worm gear may be formed on an outer peripheral surface of the sliding shaft to be geared into the worm and rotatably inserted into the fitting part.

A fixing member may be screw-connected on an upper side of the fitting part so as to impede a rotation of the actuator pin.

A slider may be integrally connected with a distal end of the sliding shaft in a front and rear direction and the slider is guided along a bore part formed in a cam cap in a front and rear direction, wherein a plurality of the sliding shafts are arranged so that each of cylinders are separated, and the slider is fitted to a separation position of the sliding shafts respectively.

According to an exemplary embodiment of the present invention, by rotating the sliding shaft to vary a center of the deviation adjustment member, a position of the output cam connected by the deviation adjustment member and the rocker arm may be varied, and accordingly, it may provide a continuously variable valve lift of an engine capable of controlling the deviation of the valve lift.

Besides, according to the present invention, since the sliding shafts are arranged so that each of cylinders may be separated, it may provide a continuously variable valve lift of an engine, which is capable of adjusting individually the deviation of the valve lift according to each of cylinders as well as preventing that the sliding shaft and the slider are attached each other.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
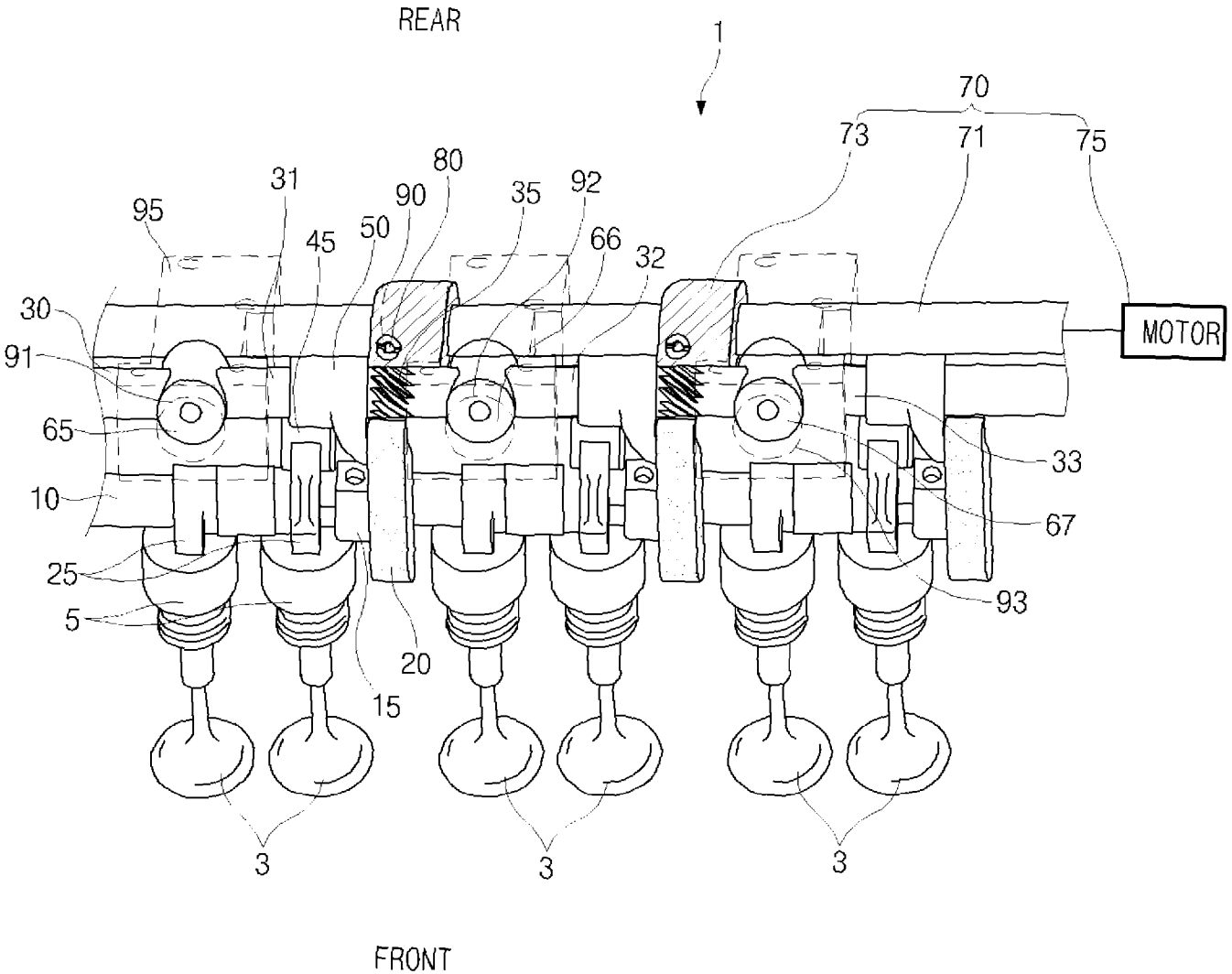
FIG. 1 is a perspective view for illustrating an exemplary continuously variable valve lift device of an engine according to the present invention.
Figure 2:
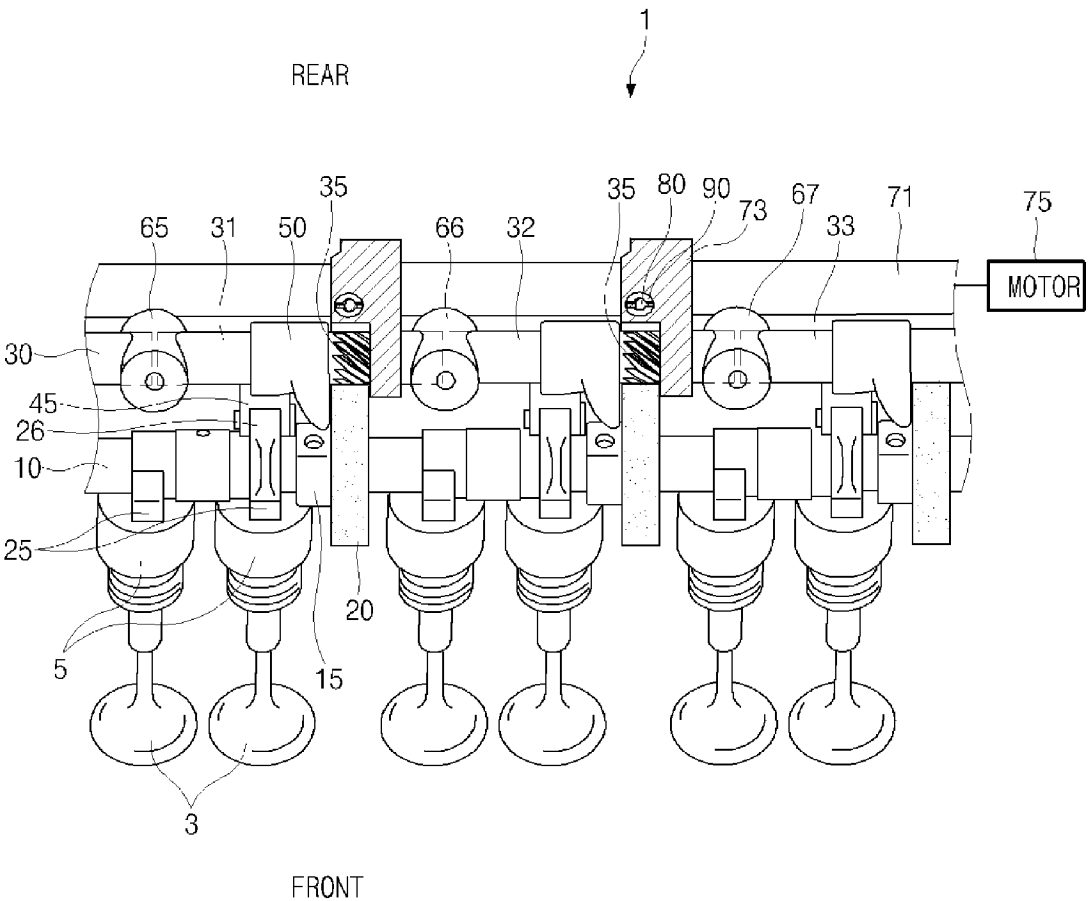
FIG. 2 is a perspective view for illustrating a state where a cam cap shown in FIG. 1 is removed.
Figure 3:
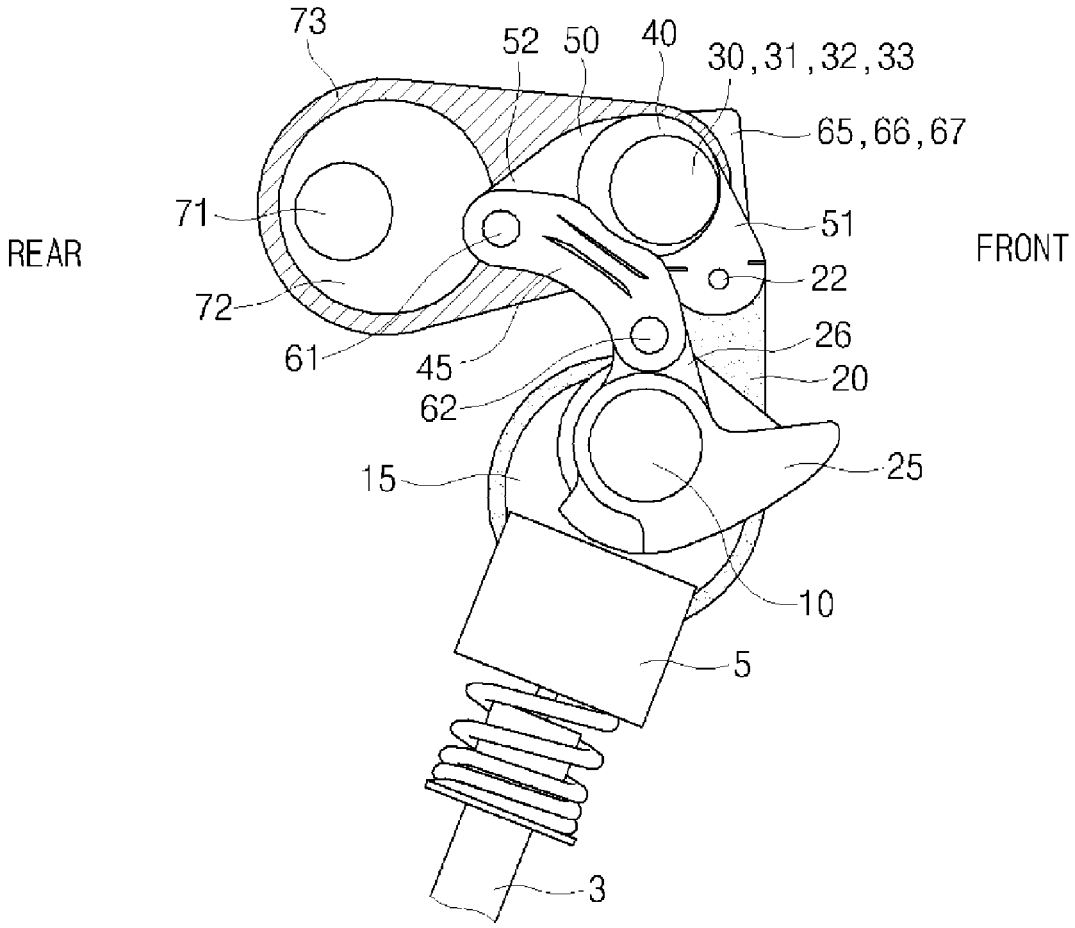
FIG. 3 is a side view of FIG. 2.
Figure 4:
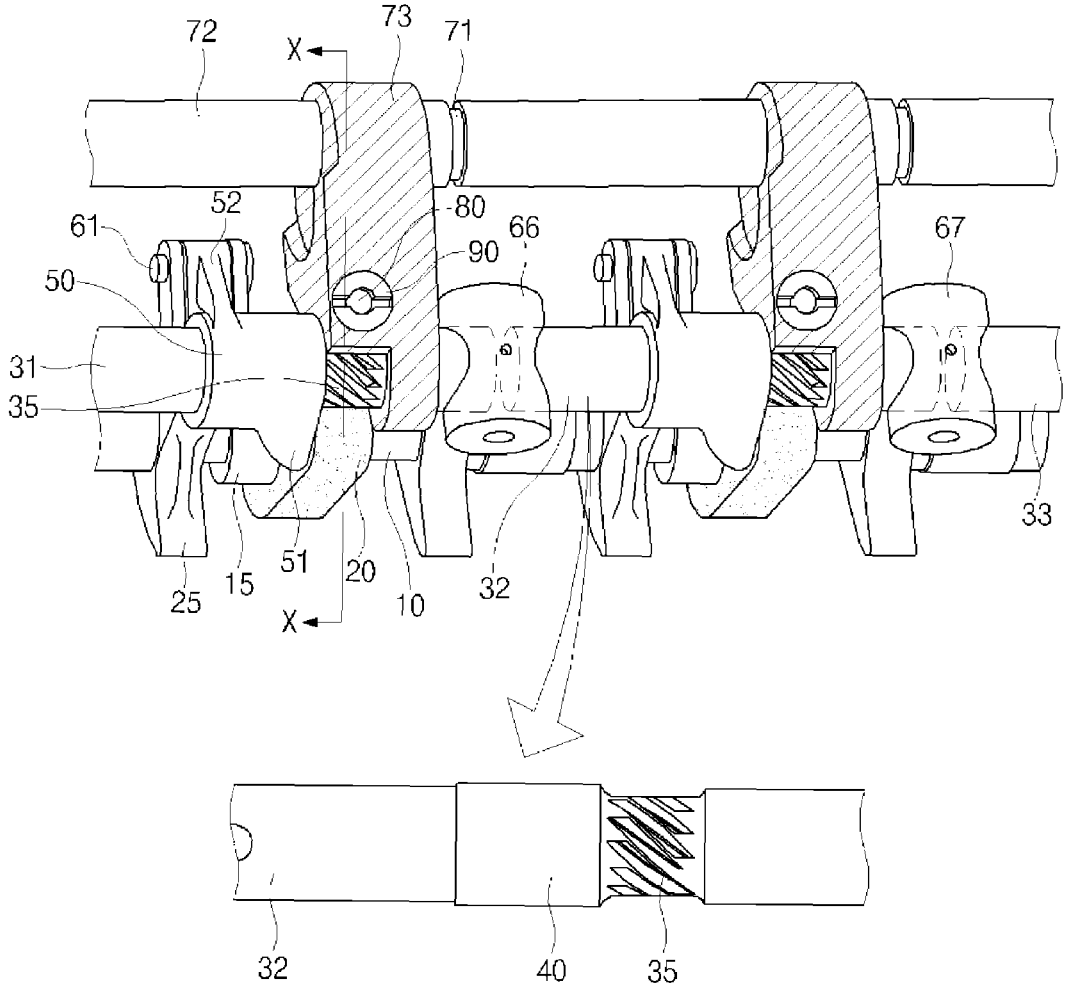
FIG. 4 is a perspective view for showing an enlarged "A" part shown in FIG. 2.

It should be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the present invention(s) will be described in conjunction with exemplary embodiments, it will be understood that present description is not intended to limit the present invention(s) to those exemplary embodiments. On the contrary, the present invention(s) is/are intended to cover not only the exemplary embodiments, but also various alternatives, modifications, equivalents and other embodiments, which may be included within the spirit and scope of the present invention as defined by the appended claims.

Now, an exemplary embodiment of the present invention will be explained in more detail with reference to the attached drawings.

As shown in FIGS. 1 to 4, a continuously variable valve lift 1 of an engine according to an exemplary embodiment of the present invention may include an cam shaft 10, a oscillating outer-race wheel 20 being fitted to be oscillated at an eccentric cam 15 which is formed on an outer peripheral surface, sliding shafts 30, 31, 32, 33 arranged to be separated from the cam shaft 10, a rocker arm 50 for rotating with the oscillating outer-race wheel 20 on the sliding shafts 30, 31, 32, 33, an output cam 25 being rotably fitted to the cam shaft 10, and a driving member 70 for varying a position of the output cam 25 by straightly moving the sliding shafts 30, 31, 32, 33.

The cam shaft 10 rotates with a crank shaft, in which the eccentric cam 15 is formed on the outer peripheral surface of the cam shaft 10 so that the oscillating outer-race wheel 20 may be fitted. Thus, the oscillating outer-race wheel 20 is oscillated in up, down, left and right along a profile of the eccentric cam 15 when the cam shaft 10 rotates.

In addition, two output cams 25 are rotably equipped to the cam shaft 10 responding to two intake valves 3 per a cylinder.

The output cam 25 is fixed to a tappet 5 which is connected with an upper side of each of intake valves 3, and accordingly, it may lift the intake valves 3 by applying a pressure into the tappet 5 according to the profile. On the other hand, a joint piece 26 is formed to protrude on a side of the output cam 25 toward to the upper direction, in which the joint piece 26 is jointed with an edge of an output cam link 45 by the second link shaft 62, wherein the output cam link 45 will be described later.

The output cam link 45 is a component for transmitting a rotation of the rocker arm 50 into the output cam 25, wherein an edge of the output cam link 45 is connected with the second arm 52 by the first link shaft 61, and another edge of the output cam link 45 is connected with the joint piece 26 of the output cams 25 by the second link shaft 62.

The sliding shafts 30, 31, 32, 33 are to vary a position of the output cams 25 by being straightly moved in a front and rear direction by means of the driving member 70 on the basis of the engine operating condition, in which they are arranged in parallel with the cam shaft 10 on the upper side of the cam shaft 10.

Here, a plurality of the sliding shafts 30, 31, 32, 33 are arranged to be separated according to each of cylinders, in which sliders 65, 66, 67 are jointed in a front and rear direction at separation positions of the sliding shafts 30, 31, 32, 33, and accordingly, edges of adjacent sliding shafts 30, 31, 32, 33 may be supported. Thus, since the sliding shafts 30, 31, 32, 33 are not formed in a body, and are manufactured to be separated according to each of the cylinders, it may solve the problem that the sliders 65, 66, 67 and the sliding shafts 30, 31, 32, 33 are fixed each other.

More specifically, each of the sliders 65, 66, 67 may slide-move along each of bore parts 91, 92 and 93 of cam caps 95 in a front and rear direction while the driving member 70 is operating, in which the heights of the bore parts 91, 92 and 93 are not the same since the bore parts 91, 92 and 93 of the cam caps 95 have each of machining Errors, and accordingly, each heights of the sliders 65, 66, 67 inserted into each of the bore parts 91, 92 and 93 are not the same as well. Thus, in case where the sliding shafts is formed in a body not to be separated in each of the cylinders according to an exemplary embodiment of the present invention, the sliders 65, 66, 67 and the sliding shafts 30, 31, 32, 33 may be fixed with each other if each heights of the sliders 65, 66, 67 are formed in a zigzag shape according to the maximum tolerance.

Figure 6:
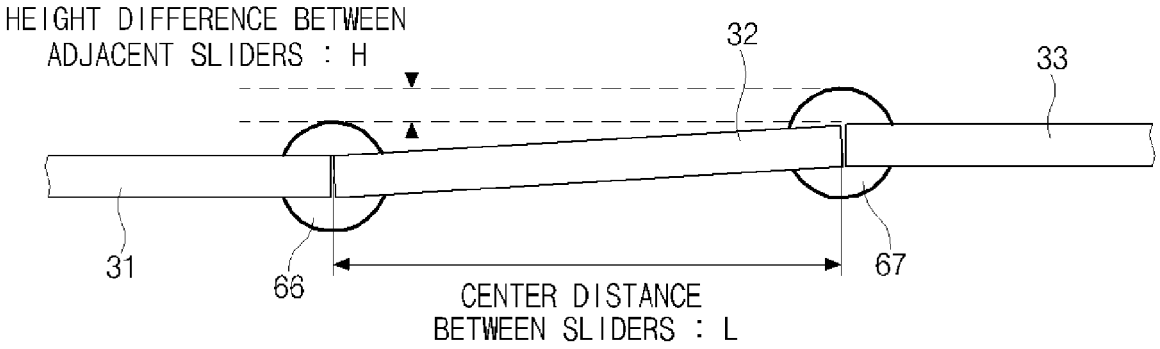
FIG. 6 is a schematic view for illustrating a state where a slider is fitted to a separation position of a sliding shaft shown in FIG. 2.

As shown in FIG. 6, the sliding shafts 30, 31, 32, 33 according to an exemplary embodiment of the present invention are separated in each of the cylinders in order to have a gap between the sliding shafts 30, 31, 32, 33 and the sliders 65, 66, 67, and accordingly, it may prevent that the sliding shafts 30, 31, 32, 33 and the sliders 65, 66, 67 are fixed with each other. Here, in order not to fix the sliders 65, 66, 67 into the sliding shafts 30, 31, 32, 33, it must be satisfied with a condition of "h/L<(a clearance between the sliding shaft and the slider)/(a radius of the slider)".

In this case, the deviation adjustment member 40 is formed in a body on each of the outer peripheral surfaces of the sliding shafts 30, 31, 32, 33 to be eccentric along a shaft line of the sliding shafts 30, 31, 32, 33, in which the rocker arm 50 is rotably combined into the deviation adjustment member 40.

The rocker arm 50 is connected with the oscillating outer-race wheel 20 to rotate on the sliding shafts 30, 31, 32, 33 according as the oscillating outer-race wheel 20 oscillates, and the rotation of the rocker arm 50 is transmitted to the output cam 25 by the output cam link 45, wherein the output cam link 45 will be described later. For this, the first arm 51 of the rocker arm 50 is connected with the oscillating outer-race wheel 20 by a connecting shaft 22, and the second arm 52 of the rocker arm 50 is connected with an edge of the output cam link 45 by the first link shaft 61, wherein the first link shaft 61 will be described later.

The deviation adjustment member 40 is formed in a body on the sliding shafts 30, 31, 32, 33 separated according to each of cylinders, and accordingly, it may adjust the deviation of the intake valve lift according to each of cylinders by rotating the sliding shafts 30, 31, 32, 33. That is, the rocker arm 50 is rotably combined into the outer peripheral surface of the deviation adjustment member 40, wherein the deviation adjustment member 40 may be rotated in a eccentric state according as the sliding shafts 30, 31, 32, 33 are rotated because the rocker arm 50 is moved with the output cam 25 by means of the output cam link 45. Thus, the rotation of the deviation adjustment member 40 may be transmitted into the rocker arm 50->the output cam link 45->the output cam 25, and accordingly, it may adjust a length of the intake valve 3 to become short or long.

In this case, the deviation adjustment member 40 is manufactured so that an amount of the deviation becomes sufficiently short, and accordingly, it may minutely adjust the deviation of the intake valve lift according to the rotation amount of the sliding shafts 30, 31, 32, 33. That is, since it must adjust the deviation of the valve lift between the cylinders under 5% in order to maintain the revolutions of the engine at a constant rate, it may minutely adjust the deviation of the valve lift by shortening the deviation amount of the deviation adjustment 40 as described in the present invention.

On the other hand, the deviation adjustment member 40 may be manufactured in a single body not to be individually manufactured apart from the sliding shafts 30, 31, 32, 33 so as to reduce a working man hour.

The driving member 70 may move the sliding shafts 30, 31, 32, 33 straightly in a front and rear direction, and accordingly, the intake valve 3 may be changed from a high lift to a low lift or from a low lift to a high lift.

For this, the driving member 70 may largely include a control shaft 71 in which a control eccentric cam 72 is formed on an outer peripheral surface of the driving member 70, a control link 73 for connecting the control eccentric cam 72 with the sliding shafts 30, 31, 32, 33, and a motor 75 for rotating the control shaft 71.

The control shaft 71 is arranged in parallel with the sliding shafts 30, 31, 32, 33 on an upper side of the cam shaft 10, in which it may be rotated by a rotation of the motor 75 so as to straightly move the sliding shafts 30, 31, 32, 33 in a front and rear direction.

The control link 73 may connect the control eccentric cam 72 with the sliding shafts 30, 31, 32, 33 so as to straightly move the sliding shafts 30, 31, 32, 33 in a front and rear direction by a rotation of the control shaft 71. In this case, an fitting part 74 (Referring to FIG. 5) is formed to be caved on an upper surface of the control link 73, in which an actuator pin 80 is inserted into the fitting part 74.

The actuator pin 80 is a component for rotating the sliding shafts 30, 31, 32, 33, in which it may be geared with a worm gear 35 formed on an outer peripheral surface of the sliding shafts 30, 31, 32, 33 because a worm 85 is formed on an outer peripheral surface of the actuator pin 80. Accordingly, if a worker rotates the actuator pin 80 in a defined direction using a tool or the like, the sliding shafts 30, 31, 32, 33 may be rotated because the worm 85 and the worm gear 35 are geared with each other. Therefore, the sliding shafts 30, 31, 32, 33 and the deviation adjustment member 40 may rotate in a body, and accordingly, the deviation of the intake valve lift may be adjusted.

On an upper side of the fitting part 74, a fixing member 90 may be screw-connected so as to impede a rotation of the actuator pin 80. In this case, the fixing member 90 may be tightened by a constant tightening torque in order to fix the actuator pin 80 forcibly in a bottom direction. Thus, by combining the fixing member 90 into the fitting part 74 after the worker adjusts the deviation of the intake valve lift by rotating the actuator pin 80, it may prevent that the actuator pin 80 may be rotated arbitrarily.

Referring to the above-described structure, the principle for adjusting the deviation of valve lift by means of the continuously variable valve lift 1 according to an embodiment of the present invention will be briefly explained as follows.

Figure 5:
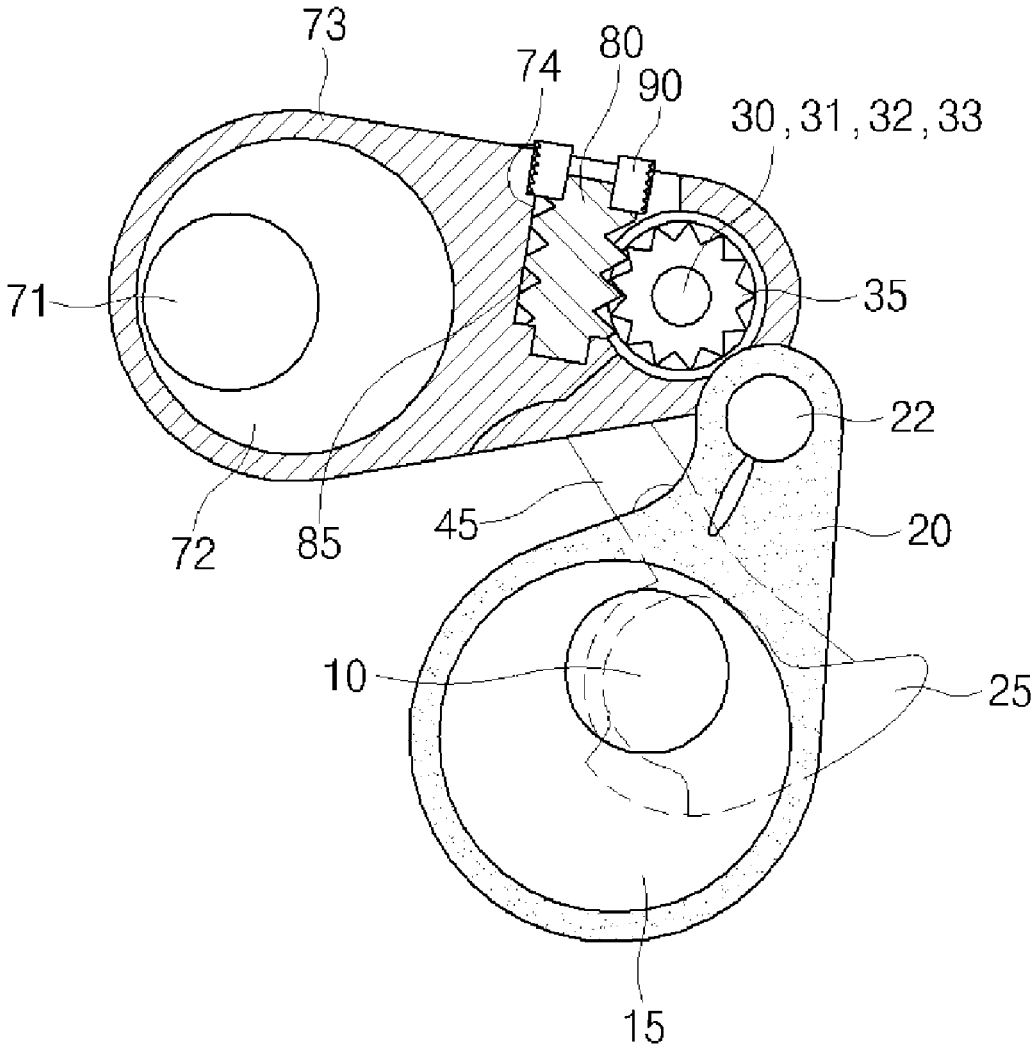
FIG. 5 is a section view which is sectioned along the X-X line of FIG. 4.

As shown in FIG. 5, in a state where the actuator pin 80 may be rotated by releasing loosely the fixing member 90 tightened in the fitting part 74, the sliding shafts 30, 31, 32, 33 may be rotated by means of gearing of the worm 85 and the worm gear 35 when the actuator pin 80 is rotated in any direction.

In this case, because the deviation adjustment member 40 is to be slightly eccentric from the center of the sliding shafts 30, 31, 32, 33, the center of the deviation adjustment member 40 may be moved when the sliding shafts 30, 31, 32, 33 are rotated.

Accordingly, it may adjust the deviation of the intake valve lift according as the position of the rocker arm 50 combined into the deviation adjustment member 40, the position of the output cam link 45 connected mutually with the rocker arm 50, and the position of the output cam 25 are minutely varied. In this case, because the deviation adjustment member 40 is arranged on the sliding shafts 30, 31, 32, 33 separated with each other, it may separately adjust the deviation of the valve lift according to each of cylinders, of course.

Thus, because the position of the output cam 25 is varied according to the rotation of the actuator pin 80, it may adjust an amount of lift of the valve 3 by varying a rotation direction and a rotation angle of the actuator pin 80.

After adjusting the deviation of the valve lift by means of the above-described processes, the assembling operation may be completed by tightening the fixing member 90 into the fitting part 74 so that the actuator pin 80 the may not deviate from the fitting part 74.

According to an exemplary embodiment of the present invention, it may vary the center of the deviation adjustment member 40 by rotating the sliding shafts 30, 31, 32, 33, and then a position of the output cam 25 connected by the deviation adjustment member 40 and the rocker arm 50 may be varied, and accordingly, the deviation of the valve lift may be adjusted.

For convenience in explanation and accurate definition in the appended claims, the terms "upper", "lower," "front", "rear", "inner," and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift device of an engine, the valve lift device comprising:

a cam shaft having an eccentric cam formed on an outer peripheral surface of the cam shaft so that an oscillating outer-race wheel is coupled to and oscillatable along the eccentric cam;

an output cam being rotably fitted to the cam shaft;

a sliding shaft for varying the position of the output cam by moving straightly in a front and rear direction according to an engine operating condition, in which the sliding shaft has a deviation adjustment member which is formed to be eccentric toward an outer peripheral surface thereof; and a rocker arm rotably fitted to the deviation adjustment member and one end of which is rotably connected to the oscillating outer-race wheel and the other end of which is rotably engaged with the output cam.

2. The continuously variable valve lift device according to claim 1, wherein the other end of the rocker arm is rotably coupled to an end of an output cam link and an end of the output cam is rotably coupled to the other end of the output cam link.

3. The continuously variable valve lift device according to claim 1, wherein a driving member is fitted to a side of the sliding shaft in order to straightly move the sliding shaft in a front and rear direction.

4. The continuously variable valve lift device according to claim 3, wherein the driving member comprises:

a control shaft being arranged parallel to the sliding shaft, in which a control deviation cam is formed on an outer peripheral surface of the control shaft;

a control link for pivotally connecting the control deviation cam with the sliding shaft; and an actuator engaged with the control shaft for rotating the control shaft.

5. The continuously variable valve lift device according to claim 4, wherein an actuator pin is rotatably inserted into an fitting part formed in an end portion of the control link and a worm is formed at an outer peripheral surface of the actuator pin, and a worm gear is formed on an outer peripheral surface of the sliding shaft to be geared into the worm and rotatably inserted into the fitting part.

6. The continuously variable valve lift device according to claim 5, wherein a fixing member is screw-connected on an upper side of the fitting part so as to impede a rotation of the actuator pin.

7. The continuously variable valve lift device according to claim 1, wherein a slider is integrally connected with a distal end of the sliding shaft in a front and rear direction and the slider is guided along a bore part formed in a cam cap in a front and rear direction.

8. The continuously variable valve lift device according to claim 7, wherein a plurality of the sliding shafts are arranged so that each of cylinders are separated, and the slider is fitted to a separation position of the sliding shafts respectively.

* * * * *